US006170211B1

(12) United States Patent
Boyce

(10) Patent No.: US 6,170,211 B1
(45) Date of Patent: Jan. 9, 2001

(54) DEMOUNTABLE WALL SYSTEM

(75) Inventor: David L. Boyce, Damascus, PA (US)

(73) Assignee: Boyce Products Ltd., Damascus, PA (US)

( * ) Notice: Under 35 U.S.C. 154(b), the term of this patent shall be extended for 0 days.

(21) Appl. No.: 09/216,522

(22) Filed: Dec. 18, 1998

(51) Int. Cl.[7] ..... E04H 1/12

(52) U.S. Cl. ..... 52/242; 52/238.1; 52/243; 52/282.2; 52/284; 52/36.6; 52/731.5; 160/135

(58) Field of Search ..... 52/238.1, 239, 52/243, 242, 282.1, 282.2, 282.4, 284, 586.1, 586.2, 126.3, 126.4, 127.1, 127.6, 127.8, 36.6, 36.1, 731.5, 731.4, 731.1; 160/135

(56) References Cited

U.S. PATENT DOCUMENTS

| | | | | |
|---|---|---|---|---|
| 3,559,357 | * | 2/1971 | Lowe . | |
| 3,866,364 | * | 2/1975 | Pollard | 52/36 |
| 4,434,900 | | 3/1984 | Cook . | |
| 4,709,517 | | 12/1987 | Mitchell et al. . | |
| 5,069,263 | | 12/1991 | Edwards . | |
| 5,155,955 | | 10/1992 | Ball et al. . | |
| 5,634,300 | | 6/1997 | Huebner et al. . | |
| 5,758,466 | * | 6/1998 | Tucker | 52/586.2 |
| 5,864,997 | * | 2/1999 | Kelly | 52/282.2 |
| 6,006,480 | * | 12/1999 | Rook | 52/309.12 |

* cited by examiner

*Primary Examiner*—Carl D. Friedman
*Assistant Examiner*—Yvonne M. Horton
(74) *Attorney, Agent, or Firm*—Rhodes & Mason, PLLC

(57) ABSTRACT

A demountable wall system mountable between, but not attached to, the floor and ceiling of a building constructed of a plurality of wall sections, each wall section including at least one upper horizontal framing member having opposed upper and lower slots; a plurality of spaced, parallel vertical framing members having opposed side slots facing side slots of adjacent vertical framing members; at least one horizontal lower member having opposed upper and lower slots; at least one vertical rectangular panel with upper, lower and opposed side edges inserted into facing slots of adjacent framing members; a floor mounting member inserted into the lower slot of the lower horizontal framing member; a vertically adjustable closure member inserted into the upper slot of the upper member to close the space between the ceiling and the upper horizontal framing member; and first and second door jamb attachment plates fitted into facing slots of adjacent vertical framing members for mounting of a door.

26 Claims, 4 Drawing Sheets

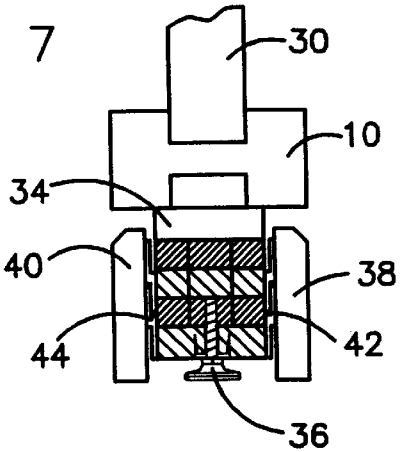
FIG. 7
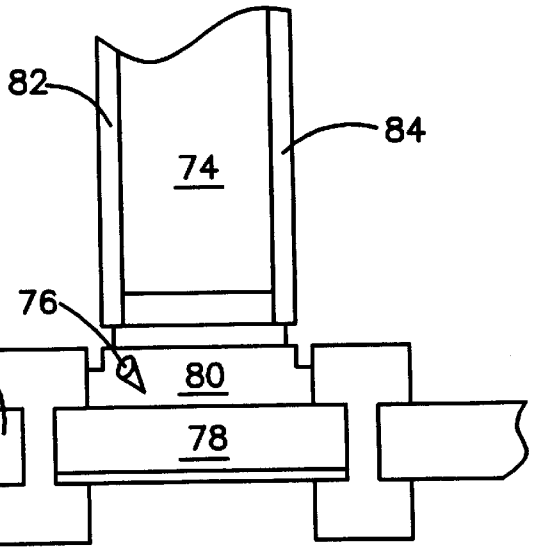
FIG. 8
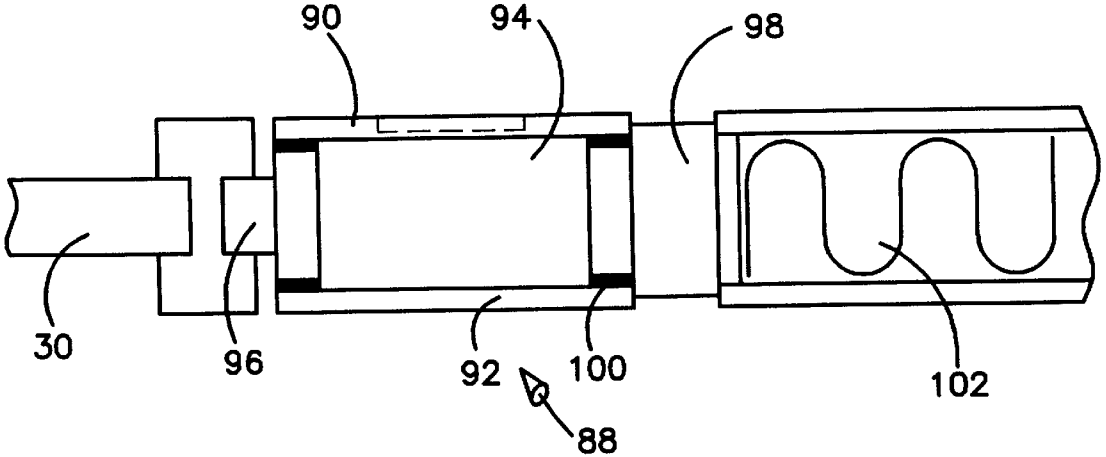
FIG. 9
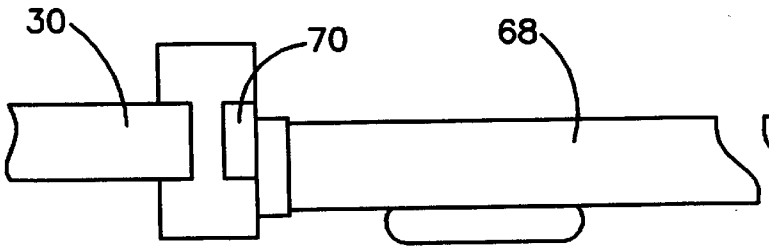

DEMOUNTABLE WALL SYSTEM

BACKGROUND OF THE INVENTION (1) Field of the Invention

The present invention relates generally to a demountable or moveable wall having the appearance of a permanently installed, floor-to-ceiling wall, and in particular to a demountable wall that can readily assembled, wired, and disassembled using a minimal number of standard components.

(2) Description of the Prior Art

Modern offices frequently require rearrangement of office space in order to address changing personnel needs and different interactions between personnel resulting from changes in the company's strategic direction. Also, many offices are in rented spaces where the management will desire to minimize the cost of significant upfitting when the office may be moved to another location. At the same time, there is a desire for an office that will be attractive both to employees and visitors.

A common way of addressing these needs is through the use of moveable, full-height partitions that can be readily rearranged into offices, workstations or cubicles. In many instances, however, greater privacy as well as improved aesthetics is desired. Therefore, the industry has also developed moveable or demountable wall systems that more closely approximate the appearance and privacy afforded by permanent floor-to-wall structures or millwork.

For example, U.S. Pat. No. 5,155,955 to Ball et al. describes a wall system in which a plurality of panels or other structural rectangular frames are joined to create a wall that extends to above door height and includes a lockable door. The side edges these frames are attached to upright connecting members, and the top of the wall is covered with an enlarged cornice providing a location for wiring and lighting. The lower ends of the upright members include adjustable feet to level the wall.

U.S. Pat. No. 4,709,517 to Mitchell et al. describes a floor-to-ceiling wall system comprised of a ceiling channel attached to the ceiling, a floor channel attached to the floor and vertical studs connecting the ceiling and floor channels. The wall system also includes horizontal stringers joining the studs, and panels attached to the stud surfaces.

These and other prior art demountable wall systems, however, require considerable steps in assembly and disassembly, including the fastening together of numerous parts, as well as attachment to the ceiling and/or the floor. Moreover, the wall systems require essentially custom manufacture to fit the desired space, substantially increasing their cost and decreasing their utility when it is desired to move the wall to another location. Also, the walls often have the appearance of temporary structure instead of permanent walls. Thus, there is a continuing need for an aesthetically pleasing wall system that can be readily assembled and disassembled using a minimal number of components. There is also the need for a wall system that has the appearance of a permanent floor-to-ceiling wall without the necessity of attaching the wall to the ceiling or to the floor.

SUMMARY OF THE INVENTION

The present invention relates to an easily demountable or moveable wall having the appearance of a permanently installed, floor-to-ceiling wall, and in particular to a demountable wall constructed of a minimal number of standard components. The invention also relates to the use of a plurality of these walls joined together to form a wall system.

In general, the demountable wall is comprised of a plurality of rectangular vertical panels supported within, but not fastened to, a framework of H-shaped support members. The wall can also include various attachment members that are fitted within the H-shaped members. These attachment members can be used to support the wall on a floor, close the opening between the top of the wall and a ceiling, connect walls, and mount doors.

A unique feature of the invention is that the wall components are not fastened to each other except at the wall ends and corners. That is, the upper and lower ends of intermediate vertical frame members merely abut the upper and lower horizontal framing members, while the panel members are merely inserted into the facing slots of framing members. As a result, these components can be easily and quickly fitted together and separated.

The rectangular vertical panels forming the wall may be identical or different. Each panel may be formed of wood, metal, plastic, glass or any combination of these materials. For example, the panel can be formed of a rectangular glass panel with a surrounding wooden frame. In addition, the framing members are desirably formed of wood.

Each H-shaped member used to frame the wall panels includes opposed panel-receiving slots or grooves, sized to receive the wall panels. That is, the thickness of the wall panel will be approximately the same dimension as the slot width, so that the panel can be inserted into the slot. It will be understood that the term "H-shaped member" is intended to describe the cross-sectional configuration of the support member, and is not intended to suggest any particular orientation of the member.

The H-shaped member may be more specifically defined as an elongated member having a rectangular cross-section with rectangular slots in two opposed faces, the slots being parallel to the longitudinal axis of the member. Unlike most of the framing members of prior art demountable walls, the framing members in the present invention are preferable made of wood.

Since all of the framing members can be of the same cross-sectional shape, it is possible to cut all members with the same settings on the saw or other equipment, and then simply cut the members to a desired length. Moreover, due to the manner is which the walls are constructed, the members can be cut to standard lengths that are useful under a variety of conditions.

More specifically, the basic wall frame is comprised of a lower horizontal H-shaped member with upper and lower opposed rectangular slots; an upper horizontal H-shaped member with upper and lower opposed slots; and one or more H-shaped vertical panel connecting members with opposed side slots. The upper and lower horizontal H-shaped members and the H-shaped vertical panel members can all have the same cross-sectional shape and dimensions. The wall also includes one or more vertical rectangular panels having a thickness substantially equal to the width of the slots on the H-shaped members, so that the edges of the panel can be snugly inserted into the facing slots of the H-shaped members.

The wall is constructed by inserting the lower edges of each vertical panel in the upper slot of the horizontal lower framing member. The sides of each panel are fitted into facing slots of vertical framing members, and the top ends of the panels are capped by inserting the upper edges of the panels into the lower slot of a horizontal upper framing member.

In order to position the wall on a floor or other horizontal surface, the wall may also include a horizontal mounting member fitted into the lower slot of the lower H-shaped member. This mounting member preferably has a horizontal cross-section with opposed upper and lower surfaces, outer and inner faces, and a width approximately equal to the width of the lower slot of the lower H-shaped member, so that the upper end of the mounting member can be snugly inserted into the lower slot of the lower H-shaped member. Vertically adjustable feet of conventional construction are secured to the lower surface of the mounting member to level the wall.

In order to hide the adjustable feet and simulate the appearance of a wall that is permanently affixed to the floor, the outer and inner faces of the mounting plate may be covered with detachable side members or plates. Each side plate may be of a horizontal cross-section with a height approximately equal to, or slightly less than, the height of the horizontal lower H-shaped member. The plates may be releasibly attached to the outer and inner faces of the lower H-shaped member with suitable fasteners.

To simulate a wall that is permanently attached to the ceiling, a vertically adjustable horizontal member or plate may be mounted in the upper slot of the upper H-shaped member to close the opening between the top of the wall and the ceiling. Generally, this adjustable member may be comprised of an elongated horizontal plate having a generally rectangular cross-section, and a width substantially equal to the upper slot of the horizontal H-shaped member, so that the plate can fit snugly into the upper slot, but be vertically moveable.

Adjustable feet are secured to the bottom of the base, and are vertically adjustable to move the plate upward so that upper surface of the horizontal plate engages the ceiling, preferably with an intermediate foam gasket. Thus, the wall will have the appearance of a permanent wall, although the wall is not actually fastened to the ceiling.

When two walls are to be joined at a corner, the end of each wall terminates at the end to be joined with a vertical H-shaped corner connecting member that extends between the floor and ceiling. These end members are then placed adjacent the corner, with the walls at a 90° angle. A vertically-oriented L-shaped connector is then fastened into the outer slots of the corner members to connect the wall ends together. This L-shaped connector is comprised of first and second sections having distal edges with a thickness substantially equal to the width of the corner member slot, and proximal edges joined to each other at a 90° angle. This L-shaped member is fastened to the corner members, with suitable fasteners, such as bolts that extend through the center sections of the corner members and into the L-shaped member.

In order to hide these fasteners and simulate the appearance of a permanent wall, the outer surfaces of the L-shaped connector can be releasibly covered with an outer vertically-oriented, L-shaped cover plate. This L-shaped cover plate is comprised of first and second sections with attached proximal edges to form an "L." The outer surfaces of the sections can be in a plane with the outer surfaces of the wall frame with which the surfaces are aligned. Suitable releasable fasteners are used to secure the L-shaped cover over the L-shaped connector.

A second wall can be attached at a 90° angle intermediate the ends of a first wall by using a T-shaped connector comprised of a connecting panel having opposed ends insertable into facing slots of two H-shaped members positioned on either side of the T-shaped connector, and a wall attachment section extending from the side of the connector to which the wall is to be attached. The wall attachment section may have a width substantially equal to the slot width of an H-shaped framing member, if the second wall is constructed in the same manner as the first wall. It will be seen, however, that the second wall may be of a different construction. A T-shaped metal plate may be attached to the tops of the walls over the T-shaped connector to provide rigidity.

A conventional door can be mounted in the wall of the present invention by inserting jamb attachment plates into the facing slots of spaced vertical H-members, and connecting the door jamb to the attachment plates. A horizontal H-shaped member is also positioned over the door, with an attachment plate being inserted into the lower slot of the horizontal H-shaped member.

The end of a demountable wall of the present invention can be attached to a permanent building wall by fastening a vertical mounting bracket having a width substantially equal to a slot width to the building wall. An H-shaped member is then fastened to the mounting bracket, and the wall is formed as noted above.

Instead of using a single panel between vertical framing members, the panel can be formed of upper and lower panel sections by the positioning of an intermediate horizontal H-shaped member with upper and lower slots between the upper and lower panel sections. In this construction, the upper panel section will have an upper edge inserted into the lower slot of the upper horizontal H-shaped member, and the upper edge of the lower panel section will be inserted into the lower slot of the intermediate H-shaped member. The lower panel section will have upper and lower edges inserted into the lower slot of the intermediate H-shaped member, and the lower slot of the lower H-shaped member, respectively. It will be understood that a wall system may include a combination of one-piece and multi-section panels.

Demountable walls, and wall systems formed therefrom, have several advantages over prior art wall systems. First, since the only fasteners required to hold the wall together are only at the end and corners of the walls, the walls can be quickly assembled and disassembled. Also, sections of the wall can be easily replaced. For example, a glass panel can be quickly replaced with an opaque panel, or a door. In addition, if the glass panel is comprised of an outer frame that is simply dry fitted around a glass panel, the glass can be easily replaced.

In addition, it will be noted that the wall systems are formed of only a few kinds of components, i.e., a plurality of H-shaped members, panels, adjustable upper and lower mounts, and a corner fastener. Thus, the wall system is relatively simply to manufacture, and the components can be arranged in a variety of configurations.

Therefore, on aspect of the invention is to provide a demountable wall comprised of a plurality of framing members having opposed slots, these members including a horizontal lower member having upper and lower slots, a horizontal upper member having upper and lower slots, and vertical members having opposed side slots; and at least one vertical rectangular panel having a lower edge inserted into the upper slot of the lower member, an upper edge inserted into the lower slot of the upper member, and side edges inserted into facing slots of side members.

Another aspect of the invention is to provide a demountable wall system comprised of a plurality of walls of the above construction.

These and other aspects of the invention will be come apparent to one skilled in the art upon a reading of the detailed description of a preferred embodiment of the invention taken with the drawings.

BRIEF DESCRIPTION OF THE DRAWINGS

FIG. 7 is a detailed sectional end view of the lower support member.

FIG. 8 is a detailed sectional top view of the mounting of a door in the wall system.

FIG. 9 is a detailed sectional top view of the mounting of a wiring conduit in the wall system.

DETAILED DESCRIPTION OF THE INVENTION

Figure 1:
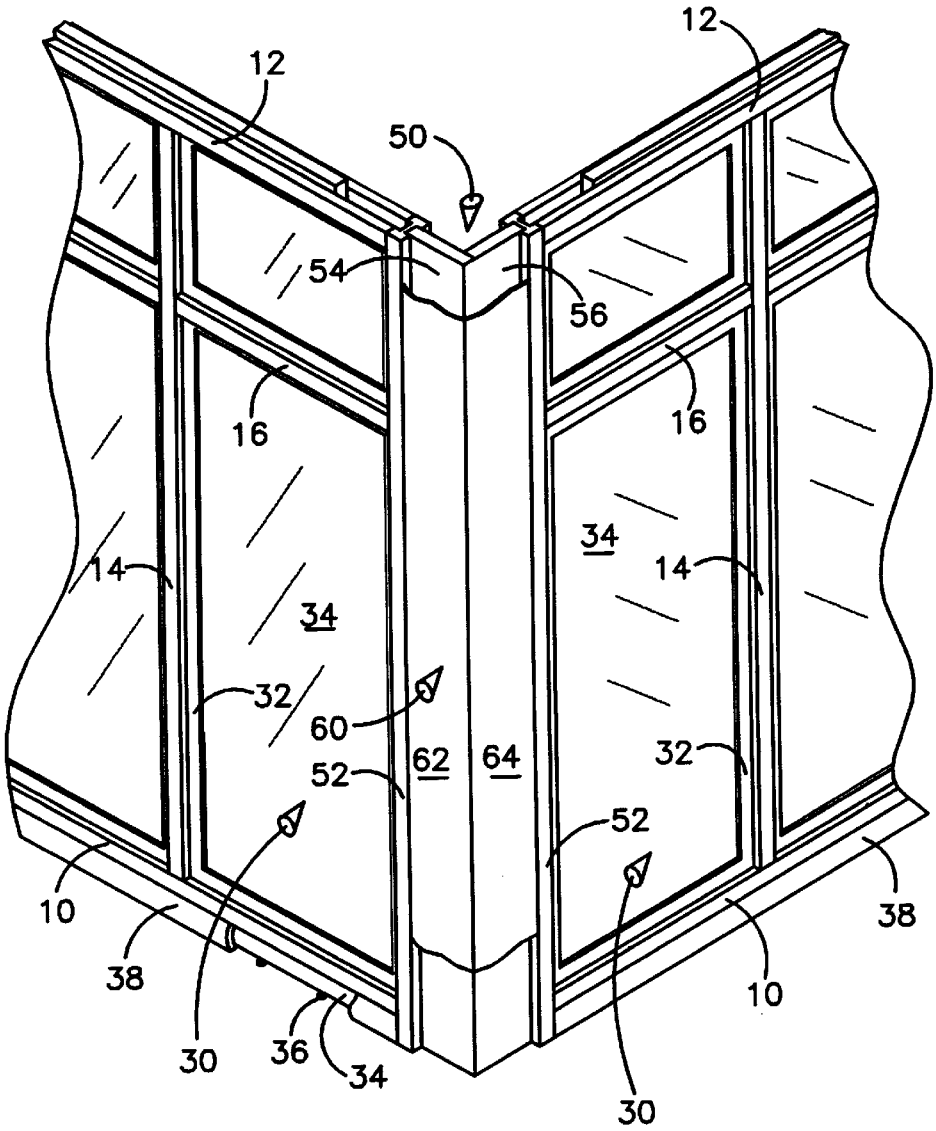
FIG. 1 is a perspective view of a wall system showing a corner connection.

In the following description, terms such as horizontal, upright, vertical, above, below, beneath, and the like, are used solely for the purpose of clarity in illustrating the invention, and should not be taken as words of limitation. Like components are identified by like numbers. The drawings are for the purpose of illustrating the invention and are not intended to be to scale.

As best illustrated in FIGS. 1–4, the wall of the present invention is comprised of a plurality of framing members, i.e., lower horizontal H-shaped members 10; upper horizontal H-shaped members 12; and vertical H-shaped connecting members 14. Intermediate horizontal H-shaped framing members 16 also form a part of the frame of the preferred embodiment. In the preferred embodiment, all H-shaped framing members, as will as other framing members of the preferred embodiment, are formed from wood. Members 10–16 all have the same cross-sectional shape and dimensions as illustrated in FIGS. 4–8.

The wall system also includes vertical rectangular panels, generally 30. While panels may be of different constructions to meet design criteria, such as the need for privacy, the panels illustrated in the preferred embodiment are comprised of a multi-section, slotted outer, wooden frame 32 and an inner glass panel 34 fitted into frame 32. Frame 32 has a width substantially equal to the width of the slots 26 and 28 in the framing members.

Figure 2:
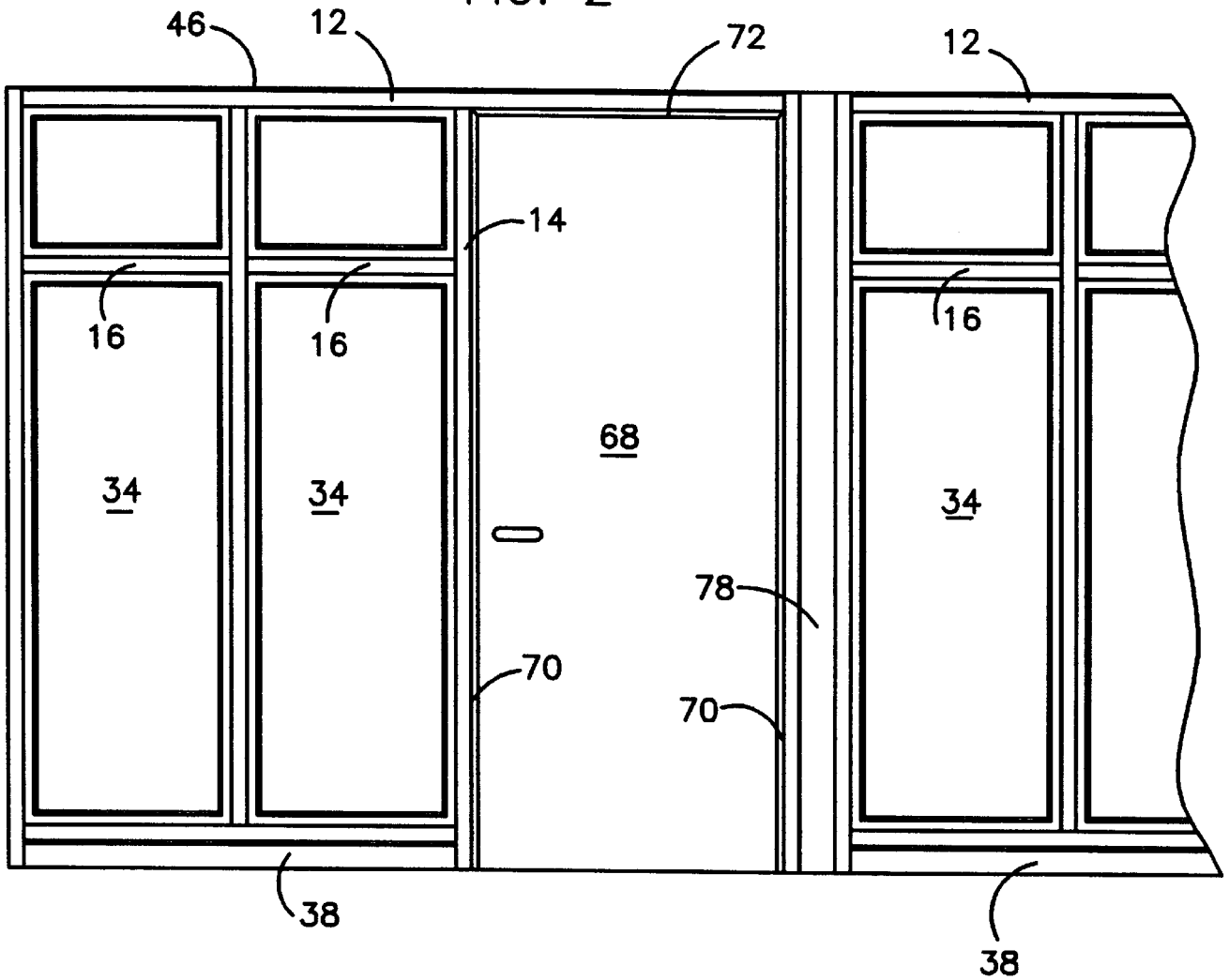
FIG. 2 is a side view of a wall with a wall panel and a door.
Figure 3:
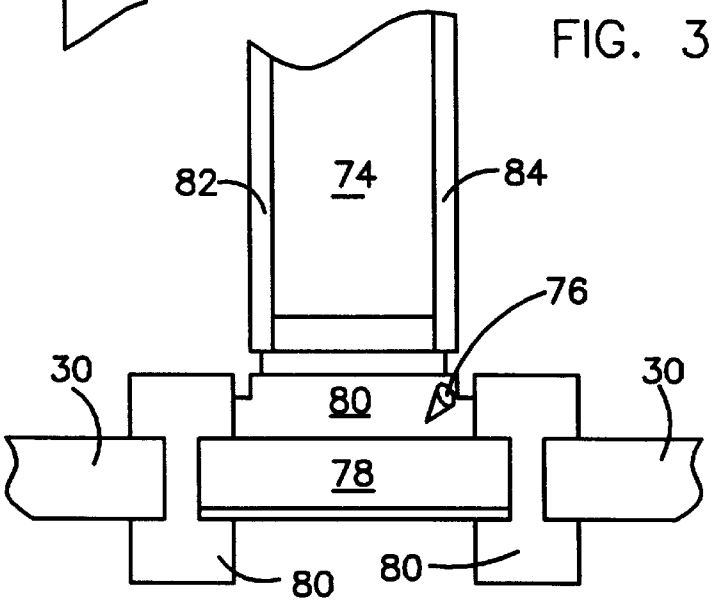
FIG. 3 is a top view of the attachment of a second wall between the ends of a first wall.
Figure 6:
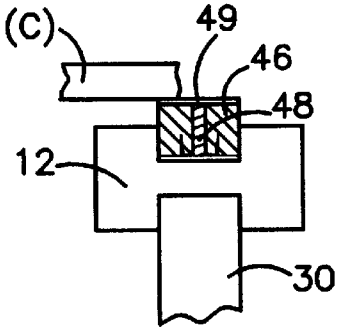
FIG. 6 is a detailed sectional end view of the upper adjustment member.
Figure 5:
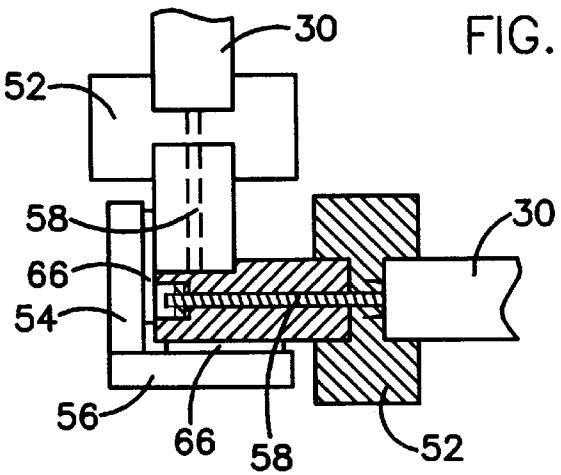
FIG. 5 is a detailed sectional top view of the corner connection.

As illustrated in FIGS. 1–3, the lower ends of panels 30 are fitted into the upper slot of horizontal lower framing member 10. Vertical framing members 14 are positioned on either side of panels 30, with the side edges of panel 30 being fitted into slots in members 14. The top edges of panels 30 are capped by inserting the top edges into the lower slot of upper framing member 16.

Horizontal mounting member 34, which has a generally rectangular cross-section and a width substantially equal to the width of the framing member slots, is used to support the wall system on a floor or other horizontal surface. The upper end of member 34 is fitted into the lower slot of lower framing member 10. Vertically adjustable mounting feet 36 are secured to the lower surface of member 34 to engage a floor surface to compensate for any floor variation and to level the wall. Member 34 can be formed of a plurality of stacked segments, permitting one or more of the segments to be removed to adjust for significant floor unevenness.

Detachable side plates 38 and 40 are releasibly attached to the outer faces of mounting member 34 with connectors 42 and 44, respectively, to hide feet 36 and simulate the appearance of a permanent wall. To simulate a wall that is permanently attached to the ceiling, a vertically adjustable member comprised of a horizontal plate 46 with adjustable feet 48, is mounted in the upper slot of the upper framing member 14 to adjustably close the opening between the top of the wall and a ceiling (C). A gasket 49 will normally be positioned between the ceiling and the top of the wall.

FIG. 1 illustrates the joining of two walls meeting at a 90° corner using a vertically-oriented L-shaped connecting member 50 fastened into the outer slots of corner framing members 12 at the ends of each wall. L-shaped connecting member 52 is constructed of a first section 54 axially aligned with one of the walls and a second section 56 axially aligned with the other wall. Section 54 has a distal end inserted into the outer slot of corner framing member 52 of the first wall and a proximal end. Section 56 has a distal end inserted into the facing slot of corner framing member 52 on the other wall and a proximal end integral with the proximal end of section 54. Fasteners 58 are used to secure L-shaped connecting member 50 to corner framing members 52.

An outer vertically-oriented, L-shaped cover plate 60 is releasibly fitted over connecting member 50 to hide fasteners 58 and to give the appearance of a permanent wall. Cover plate 60 is comprised of a first section 62 parallel to the first wall and a second section 64 parallel to the second wall. The proximal ends of sections 62 and 64 are integrally joined at a 90° angle. Releasable connectors 66 join the inner walls of sections 62 and 64 to cover plate 60.

As best illustrated in FIGS. 2 and 8, a door 68 can be mounted between two framing members 14 by inserting side jamb attachment plates 70 into the facing slots of spaced members 14, and a top jamb attachment plate 72 into the lower slot of the upper horizontal framing member 12.

Figure 4:
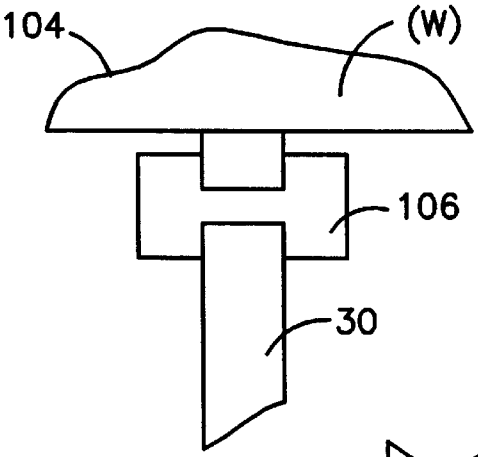
FIG. 4 is a top view of the end of a wall attached to a permanent wall.

As best illustrated in FIG. 3, a second wall 74 can be attached at a 90° angle to a first wall intermediate the ends of the first wall using a T-shaped connecting member 76 formed of a first section 78 having opposed ends fitted into facing slots of floor-to-ceiling end framing members 80, and a second section 82 extending at a 90° angle from the center of section 78. The second wall may be of the same construction as the first wall or of a different construction. For example, as illustrated, the second wall is comprised of a pair of spaced acoustical panels 84 and 86 attached to section 82. The interior space between panels 84 and 86 may be hollow or filled with insulation. Also, a portion of the space may be used for electrical or utility wiring. As illustrated in FIG. 4, the end of a wall may be attached to a permanent wall (W), such as the side of a room, with a vertical mounting plate secured to the wall (W), and an end framing member secured to mounting plate.

FIG. 9 illustrates the insertion of a wiring conduit 88 into a wall. Conduit 88 is comprised of spaced outer walls 90 and 92 on either sides of connecting members 96 and 98. Walls 90 and 92 may be attached with hook-and-loop fasteners 100, or other releasable fasteners for ready access to the interior 94 of conduit 88. Members 96 and 98 joining conduit 88 can be used to join the conduit to the end of a panel 30, or to a hollow wall section filled with an insulating material 102.

Certain modifications and improvements will occur to those skilled in the art upon a reading of the foregoing description. Such modifications and improvements have been deleted herein for the sake of conciseness and readability but are properly within the scope of the follow claims.

What is claimed is:

1. A demountable wall comprised of:

a) a plurality of framing members having H-shaped cross-sections, said members including a horizontal lower framing member having upper and lower slots, a horizontal upper framing member having upper and lower slots, and vertical framing members having opposed side slots;

b) at least one vertical rectangular panel having a lower edge inserted into the upper slot of said lower member, an upper edge inserted into the lower slot of said upper member, and side edges inserted into facing slots of said side members;

c) a mounting member having opposed sides, an upper edge and a lower edge, said upper edge being fitted into the lower slot of said lower member; and d) horizontal cover plates releasibly attached to the opposed sides of said mounting member.

2. The wall of claim 1, further including first and second door jamb attachment plates fitted into facing slots of adjacent vertical framing members.

3. The wall of claim 1, wherein said wall panel is comprised of a rectangular outer frame, said frame having outer edges inserted into slots of said framing members, and a center section mounted in said outer frame.

4. The wall of claim 3, wherein said rectangular outer frame is wood and said center section is glass.

5. The wall of claim 1, wherein said wall panel is comprised of an upper panel section having a lower edge and a lower panel section having an upper edge, said wall further including an intermediate horizontal framing member with opposed upper and lower slots between said upper and lower panel sections, the lower edge of said upper panel section being inserted into the upper slot of said intermediate framing member, and the upper edge of said lower panel section being fitted into the lower slot of said intermediate framing member.

6. A demountable wall system comprising a plurality of wall sections, including first and second wall sections joined at a corner, each wall section including:

a) a plurality of framing members, said members including a horizontal lower framing member having upper and lower slots, a horizontal upper framing member having upper and lower slots, and vertical framing members having opposed side slots;

b) a vertical rectangular panel having a lower edge fitted into the upper slot of said lower member, an upper edge inserted into the lower slot of said upper member, and side edges inserted into facing slots of said side members said first and second walls having a vertical corner framing member with an outer slot adjacent said corner; and c) a corner attachment member having a first end inserted into the outer slot of said first wall and a second end inserted into the outer slot of said second wall.

7. The wall system of claim 6, further including a mounting member having opposed sides, an upper edge and a lower edge, said upper edge being fitted into the lower slot of said lower member.

8. The wall system of claim 7, further including horizontal cover plates releasibly attached to the opposed sides of said mounting member.

9. The wall system of claim 6, further including a vertically adjustable member fitted into the upper slot of said upper member.

10. The wall system of claim 6, further including first and second door jamb attachment plates fitted into facing slots of adjacent vertical framing members.

11. The wall system of claim 6, wherein said wall panel is comprised of a rectangular outer frame, said frame being fitted into slots of said framing members, and a center section mounted in said open frame.

12. The wall system of claim 11, wherein said rectangular outer frame is wood and said center section is glass.

13. The wall system of claim 6, wherein said wall panel is comprised of an upper panel section having a lower edge and a lower panel section having an upper edge, said wall further including an intermediate horizontal framing member with opposed upper and lower slots between said upper and lower panel sections, the lower edge of said upper panel section being fitted into the upper slot of said intermediate framing member, and the upper edge of said lower panel section being fitted into the lower slot of said intermediate framing member.

14. The wall system of claim 6, further including a detachable cover plate over said vertical corner framing member.

15. The wall system of claim 6, wherein one of said walls includes a secondary wall attachment member between two parallel vertical framing members having facing slots, said secondary wall attachment member having opposed sides and opposed side edges, one of said side edges being fitted into the facing slot of one of said vertical framing members, and the other of said side edges being fitted into the facing slot of the other of said vertical framing members, said secondary wall attachment member further including a wall attachment fitting projecting from one of said sides.

16. A demountable wall system to be mounted between the floor and ceiling of a building without being attached to either the floor or the ceiling, said wall system being comprised of a plurality of wall sections, each wall section including:

a) at least one upper horizontal framing member having opposed upper and lower slots;

b) at least one horizontal lower member having opposed upper and lower slots;

c) a plurality of spaced, parallel vertical framing members having opposed side slots facing side slots of adjacent vertical framing members, said vertical framing members having opposed ends abutting, but not fastened to, said upper and lower horizontal framing members;

d) at least one vertical rectangular panel with upper, lower and opposed side edges, said panel lower edge being inserted into the upper slot of said lower member, said panel upper edge being inserted into the lower slot of said upper member, and side panel side edges being inserted into facing slots of said side members;

e) a floor mounting member having opposed sides, an upper edge and a lower edge, said upper edge being inserted into the lower slot of said lower member, said mounting member including adjustable feet extending downwardly from said lower edge;

f) a vertically adjustable closure member having an upper edge to contact said ceiling and a lower edge, said lower edge being inserted into the upper slot of said upper member, said closure member including adjustable feet attached to the closure member lower edge and engaging said upper framing member, whereby adjustment of said feet adjusts the vertical position of said closure member; and g) first and second door jamb attachment plates fitted into facing slots of adjacent vertical framing members.

17. The wall system of claim 16, wherein at least one wall panel is comprised of an upper panel section having a lower edge and a lower panel section having an upper edge, said wall further including an intermediate horizontal framing member with upper and lower slots, the lower edge of said upper panel section being inserted into the upper slot of said intermediate framing member, and the upper edge of said lower panel section being fitted into the lower slot of said intermediate framing member.

18. The wall system of claim 16, including first and second walls joined at a corner, each of said walls having a vertical corner member with an outer slot adjacent said corner, said wall system further including an corner attachment member having a first and second sections with proximal and distal ends, the proximal ends of said sections being attached to each other, the distal end of said first section being inserted into the outer slot of said first wall corner member, and the distal end of said second section being inserted into the outer slot of said second wall corner member.

19. The wall system of claim 18, further including a detachable cover member over said corner attachment member, said cover member including a first section parallel to the first section of said corner attachment member, and a second section parallel to the second section of said corner attachment member.

20. The wall system of claim 16, including a first wall and a second wall, said first wall including a wall attachment member between two vertical framing members having facing slots, said wall attachment member opposed side edges inserted into the facing slots of said vertical framing members, said second wall having an end attached to said wall attachment member.

21. The wall system of claim 16, wherein all of said framing members have the same cross-sectional dimensions.

22. A demountable wall comprised of:

a) a plurality of framing members having H-shaped cross-sections, said members including a horizontal lower framing member having upper and lower slots, a horizontal upper framing member having upper and lower slots, and vertical framing members having opposed side slots;

b) at least one vertical rectangular panel having a lower edge inserted into the upper slot of said lower member, an upper edge inserted into the lower slot of said upper member, and side edges inserted into facing slots of said side members; and c) a vertically adjustable closure member fitted into the upper slot of said upper member.

23. The wall of claim 22, further including first and second door jamb attachment plates fitted into facing slots of adjacent vertical framing members.

24. The wall of claim 22, wherein said panel is comprised of a rectangular outer frame, said frame having outer edges inserted into slots of said framing members, and a center section mounted in said outer frame.

25. The wall of claim 22, wherein said panel is comprised of an upper panel section having a lower edge and a lower panel section having an upper edge, said wall further including an intermediate horizontal framing member with opposed upper and lower slots between said upper and lower panel sections, the lower edge of said upper panel section being inserted into the upper slot of said intermediate framing member, and the upper edge of said lower panel section being fitted into the lower slot of said intermediate framing member.

26. The wall of claim 22, further including a mounting member having an upper edge fitted into the lower slot of said lower member.

* * * * *